US006729553B1

(12) United States Patent
Hlousek

(10) Patent No.: US 6,729,553 B1
(45) Date of Patent: May 4, 2004

(54) INJECTING A FLUID AT A VARIABLE INJECTION PRESSURE

(75) Inventor: Jaroslaw Hlousek, Golling (AT)

(73) Assignee: Robert Bosch GmbH, Stuttgart (DE)

( * ) Notice: Subject to any disclaimer, the term of this patent is extended or adjusted under 35 U.S.C. 154(b) by 36 days.

(21) Appl. No.: 09/718,362

(22) Filed: Nov. 24, 2000

(30) Foreign Application Priority Data

Nov. 24, 1999 (DE) ..... 199 56 519

(51) Int. Cl.[7] ..... F02M 47/02
(52) U.S. Cl. ..... 239/88; 239/90; 417/505
(58) Field of Search ..... 239/88, 90, 89; 417/505

(56) References Cited

U.S. PATENT DOCUMENTS 5,954,487 A * 9/1999 Straub et al. ..... 525/107

6,227,823 B1 * 5/2001 Paul et al. ..... 417/228

* cited by examiner

*Primary Examiner*—Christopher Kim
(74) *Attorney, Agent, or Firm*—Ronald E. Greigg

(57) ABSTRACT

The invention relates to a device for injecting a fluid, which is at high pressure, through an injection nozzle and an externally actuated actuating device received with prestressing on a pump element. In the pump element, a control element triggerable by a magnetic actuator is received, with which high-pressure lines can be made to communicate with one another. The control element is assigned two spring means, which generate a closing force that on the high-pressure side closes the control edge of the switchable control element and/or open a control edge to a low-pressure chamber.

9 Claims, 4 Drawing Sheets

INJECTING A FLUID AT A VARIABLE INJECTION PRESSURE

FIELD OF THE INVENTION

The invention relates to a device for injecting a fuel at a variable injection pressure, an example being a cam-driven pump-line-nozzle system. Such devices are used in direct injection systems in internal combustion engines.

BACKGROUND OF THE INVENTION

In devices for injecting fuel on the order of the pump-line-nozzle system, the injection pressure is dependent on the driving rpm, or in otherwords the engine rpm. In such devices, only the injection onset can be controlled by a valve, acting as a magnetic switching valve; the pressure of the injection pressure is dependent on the driving rpm. Thus in this injection configuration, the pressure of the injection event cannot be preselected freely.

From U.S. Pat. No. 5,628,293, an electronically controlled fluid injector is known, with a fluid collection chamber and with a directly triggerable control element for opening the connecting line between the fluid collection chamber and the injection nozzle that protrudes into the combustion chamber of an internal combustion engine. In addition to the first, directly triggerable injection element, another pressure control element can be moved back and forth between two control positions. By means of the two switchable pressure control elements, hydraulic forces that act counter to one another can be balanced out. In this configuration, control of the pressure elements is done via two units, which are only partly secured against overpressure or an excess quantity in the event of failure of the control system.

OBJECT AND SUMMARY OF THE INVENTION

With the proposal according to the invention of a device for injecting a fluid at variable injection pressure, the level of the injection pressure is independent of the engine rpm. The course of injection can be controlled as needed independently of the engine rpm, since the triggering of the control element, which is acted upon on its respective face ends by two spring means, is done electronically via a control unit. The onset of injection can likewise be defined and determined with extreme accuracy by means of a triggerable switching element. The course of injection of the single-cylinder injection pump with variable injection pressure is varied by the course of the piston motion toward top dead center. This variation can be defined by suitable shaping of the cam in the process of designing it. The actuating element, which is in the form of a roller rotatably supported on a piston rod, is for instance moved by a cam, in accordance with the contour of the cam. Accordingly, the course of the injection event can thereby be varied.

The proposed embodiment of a device for injection makes a major contribution to system safety, since filling of the pump chamber does not occur if the switching valve, preferably embodied as a fast-switching magnet valve, is without electrical current. The spring means on the side toward the switching valve generates a greater force and causes the control element to be pressed against the seat face and causes closure of the high-pressure-side inlet. This prevents filling of the pump chamber, and the system is incapable of injecting any fuel. If the control element, in the event of a malfunction, remains stuck in an open position, then a short circuit of the flowing fuel takes place from the pressure chamber into the low-pressure chamber. As a result, excess fuel can be prevented from achieving injection and causing engine damage.

By equipping the control element with a pressure stage in the region of the inlet-side bore for supplying the injection nozzle with fuel, the control element in interaction with the magnet valve can function as a safety valve. If a maximum possible system pressure is exceeded, an uncovering of the control edge in the low-pressure region takes place; that is, the inlet to the low-pressure chamber is uncovered on one face end of the control element. The fuel then flows directly from the pressure chamber into the low-pressure chamber, so that the forces occurring at the roller tappet do not exceed its load limits.

In the method according to the invention for controlling a device for injecting fuel, the pressure buildup in a single-cylinder pump unit takes place as a function of the stroke of the pump piston; this stroke is imposed by the camshaft via the actuating device received in the lower region of the pump piston. The course of injection can be controlled by suitable shaping of the cam. The end of pumping is brought about when the control element reaches an intermediate position at half the stroke length, and in this position, as a result of the mutually balancing forces of the spring means and of the magnet valve, it remains open on both seat faces toward the high-pressure-side injection nozzle inlet and at the outlet into the low-pressure chamber; the pressure thus drops rapidly. Injection at the nozzle is now suppressed.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
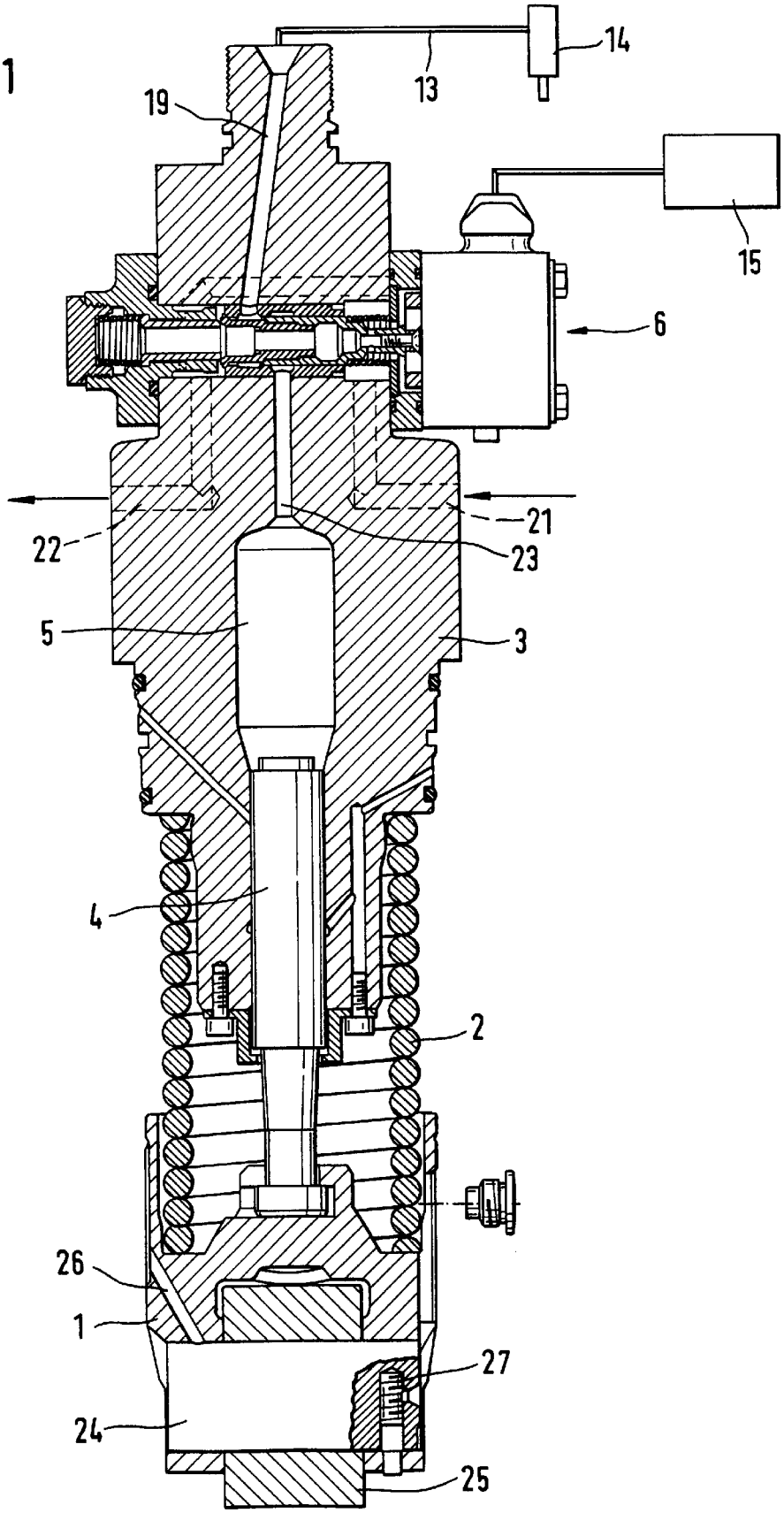
FIG. 1 is a longitudinal section through the pump element, with a pump piston received on the roller tappet.

FIG. 1 shows the longitudinal section through the pump element of a device for injection fuel.

A roller tappet 1 is received in the pump element 3, which is embodied substantially rotationally symmetrically. A pump piston 4 protruding into a pressure chamber 5 is received on the upper end of the tappet, and an actuating device in the form of a roller 25 is received on its lower end. The lower part, receiving the actuating device 25, is prestressed via a spring 2. The tang 24 is supported in the lower part of the roller tappet 1; it is supplied with lubricant via a bore 26 and is retained in the lower part of the roller tappet 1 by means of a pin assembly 27. In the upper part of the device for injecting fuel, which is embodied as a single-cylinder pump unit, the control element 8, actuatable by a magnetic actuator 6, is built in transversely to the axis of symmetry of the pump element 3. The magnetic actuator 6—preferably embodied as a fast-switching magnet valve, is triggered via a control unit 15. In the region of the control element disposed transversely to the axis of symmetry of the pump element 3, a fuel inlet 21 discharges into a hollow space, which receives an energy-storing means, between the magnetic actuator 6 and the control element 8. Discharging into the region of the sleeve 12 surrounding the control element 8 are both a bore 23, extending from the pressure chamber 5 in the pump element 3, coaxial to the line of symmetry of the pump element 3, and a high-pressure-side bore 19 extending to the injection nozzle 14. The orifice of the high-pressure-side bore 19 discharges somewhat offset from the bore 23.

The variant embodiment shown in FIG. 1 involves a pump-line-nozzle system, in which a line 13 is connected between the pump element 3 and the injection nozzle 14. In other variant embodiments, the injection nozzle 14 can also be secured directly to the pump element 3, without the interposition of a line; however, this option is not shown here.

An outlet bore 22 is provided in the region of the low-pressure end of the control element 8, and from it excess fuel out of the pump element 3 can be pumped back into the supply tank via a return line.

Figures 2, 7:
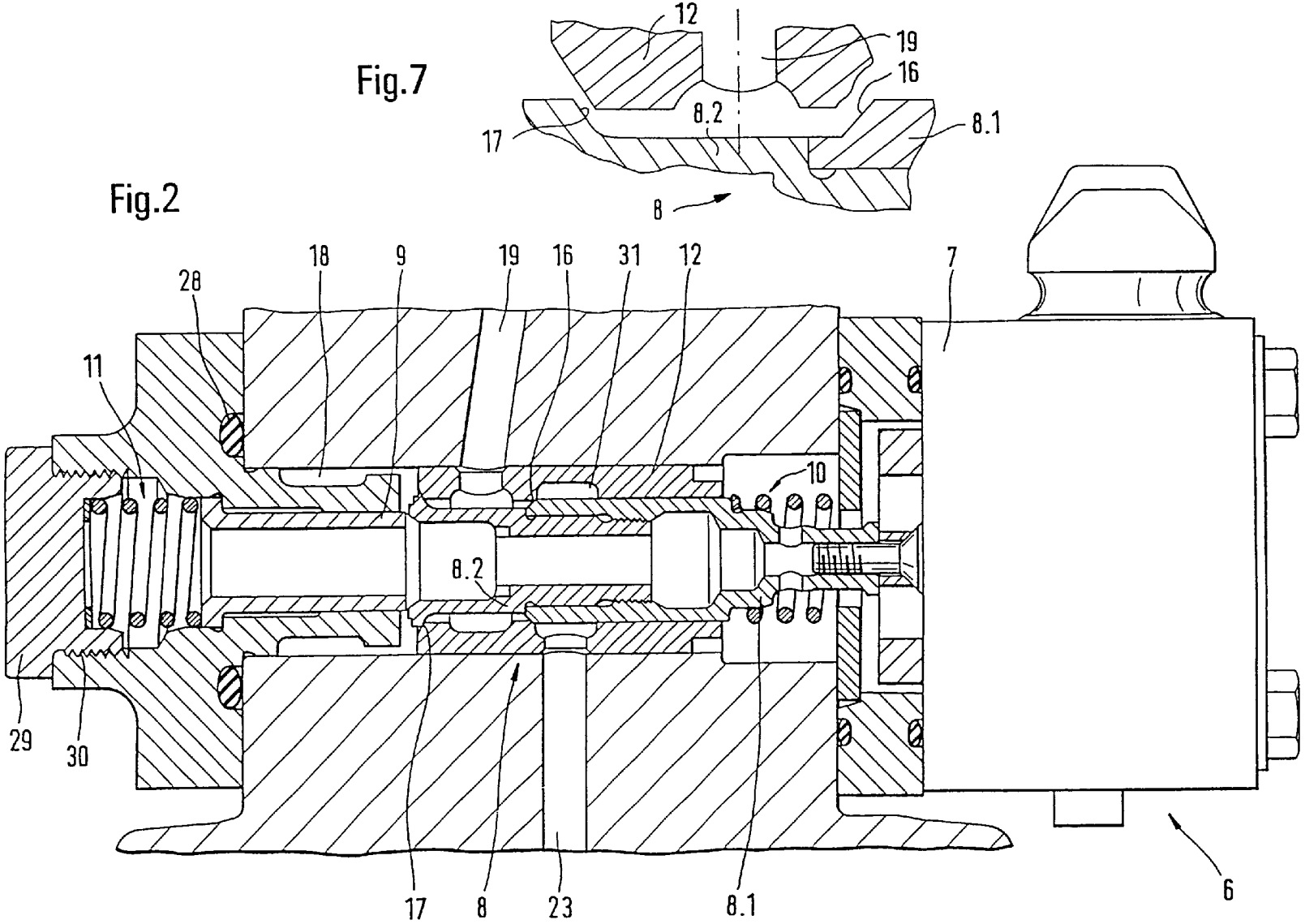
FIG. 2 is a longitudinal section through the control element in the single-cylinder pump unit, which control element controls the injection events.
FIG. 7 is a showing of a portion of FIG. 2, but greatly enlarged to exaggerate the clearances for the control edges, and also allow for the movement of the control member.

FIG. 2 shows a longitudinal section through a control element, which is received in the pump element and coordinates the injection events that are to be executed.

The control element 8 comprises two joined-together parts, that is, an outer part 8.1 and an inner part 8.2. It is surrounded by a sleeve 12 that is let into the pump housing of the pump element 3, preferably being shrunk fit into it. Annular chambers 31 are let into the sleeve 12, which by comparison with the material comprising the pump element 3 is of higher-grade material, and the bore 23 on the pressure chamber side and the bore 19 on the nozzle inlet side discharge respectively into these annular chambers. The orifices of the bores 19 and 23 are each offset from one another in the region of the sleeve 12.

Hollow spaces are provided on both sides of the sleeve 12 that surrounds the control element 8, and in each of these spaces a respective spring means 10 and 11 is received, which acts on a respective face end of the control element 8. The spring means 10, 11, preferably embodied as spring elements, are dimensioned such that the spring force of the spring means 10 on the magnetic actuator side is dimensioned to be greater than that of the force of the energy-storing means 11 placed on the low-pressure side. The spring means 10, preferably embodied as a helical spring, surrounds a narrowed region on the control element 8, in which region the control element is connected to the magnet 7 of the magnetic actuator 6.

Located on the low-pressure end of the control element 8 is a spring stop 29, which is screwed to a base with a sleevelike component 9 let into it. The spring means 11, likewise preferably embodied as a helical spring, is received between the face end of the sleeve 9 remote from the control element 8 and a cup-shaped insert of the spring stop 29. The return line 22 of FIG. 1, through which excess fuel is returned to the supply tank, discharges between the sleeve 12 and the walls of the bore of the pump element 3 which receives the sleeve 12 surrounding the control element. For the sake of sealing off the low-pressure region of the control element 8, a sealing element 28 is let into an annular recess in the base.

The control edge 17, which seals off the low-pressure chamber 18, is embodied on the inner part 8.2 of the control element 8. The control edge 16, which connects the high-pressure-side bores 19 and 23 to one another, is located on the outer part 8.1 of the control element 8. The configuration of the control edge 16 on the outer part 8.1 of the control element 8 is shown in detail on larger scale in FIG. 3.

Figure 3:
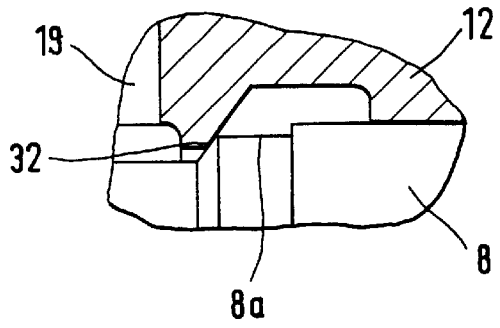
FIG. 3 is an enlarged view of the pressure stage in the region of the high-pressure inlet at the control element.

FIG. 3 is an enlarged view of the pressure stage on the control element in the region of the high-pressure inlet to the injection nozzle 14. In the region of the control edge 16 on the control element 8, which cooperates with the annular chambers 31 of the sleeve 12 of the pump element 3, a pressure stage 8*a* is embodied in the form of a diameter narrowing. This diameter narrowing is in the range between 0.05 mm and 0.2 mm where the pressure stage 8*a* is embodied with a lesser diameter, compared with the adjoining diameter region of the control element 8.

The mode of operation of the single-cylinder pump unit described in conjunction with FIGS. 1–3 is as follows:

Via the inlet line 21, the hollow space toward the magnetic actuator, which space receives the spring means 10, an aspiration of fuel occurs upon the downward motion of the pump piston 4; the pressure chamber 5 slowly fills with fuel. To that end, the magnetic actuator 6 is suitably supplied with current via the control unit 15, and the control element 8 is in the open position. If the pump piston 4 moves from bottom dead center 35 in the direction of its top dead center 36, the control element 8 is moved to its closed position. During the upward motion, there is no current to the magnetic actuator 6; the two spring means 10, 11 acting on the control element 8, with spring 10 being stronger than spring 11, keep the control element 8 in its closed position; the control edge 16 prevents the bores 19 and 23 on the high-pressure side in the pump element 3 from being put into communication with one another. The fuel pressure in the pressure chamber 5 increases upon the motion of the roller tappet 1 as a function of the stroke of the pump piston 4, as long as the control element 8 remains in its position that closes the inlet bore 19 to the bore 23. As long as there is no current to the magnetic actuator 6, the closing force is imposed only by the spring means 10 on the magnetic actuator side.

The supply onset occurs when current is delivered to the magnetic actuator 6 and the control element 8 moves toward the magnetic actuator, and thus the low-pressure chamber 18 is closed against the entrance of fuel at its seat face 17. Simultaneously, the control edges 16, 32 open, so that fuel at high pressure flows from the bore 23 into the annular chamber 31, along the pressure stage 8*a* provided on the control element 8 in the region of the control edge 16. The fuel flows into the bore 19 leading to the injection nozzle 14. Depending on the onset of triggering of the control element 8 by the magnetic actuator 6, the course of injection pressure can be varied by the motion of the pump piston 4 during the upward motion in the direction of top dead center 36. Influence can be exerted on the course of the injection pressure, for instance via a suitable shaping of the various cams on which the actuating devices 25 embodied as roller bodies roll, received on the lower end of the roller tappet 1.

As long as the holding current 42 stays at a first, higher level, the control element 8 closes off the annular chambers 31 by contact of the control edge 16. Conversely, if by means of the control unit that operates the magnetic actuator 6 the holding current is lowered to a lower level 43, a force equilibrium ensues at the control element 8. The force generated by the magnetic actuator 6 and the spring force of the spring means 11 are in equilibrium with the spring means 10 on the magnet valve side. As a result, the control element 8 assumes an intermediate position halfway along the stroke length in the sleeve 12, in which position both control edges 16 and 17 are each open, as shown in FIG. 7. In this position of the control element 8, the communication between the pressure chamber 5 of the pump element 3, the communication with the injection nozzle 14 via the line 19, and the opening of the low-pressure chamber 18 remain open. The result is a rapid drop in pressure, so that the injection event is quickly ended.

Figure 4:
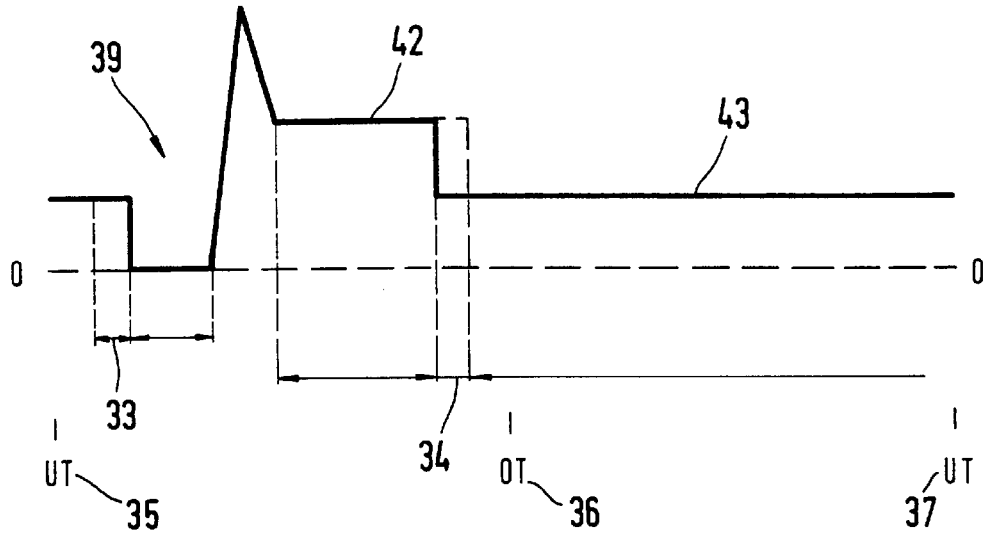
FIG. 4 shows the course of current at the magnetic actuator, plotted over the pump piston travel from bottom dead center to top dead center and back to bottom dead center again.

FIG. 4 shows the current course of the magnetic actuator, plotted over the travel of the pump piston from bottom dead center to top dead center and back to bottom dead center again.

Figure 5:
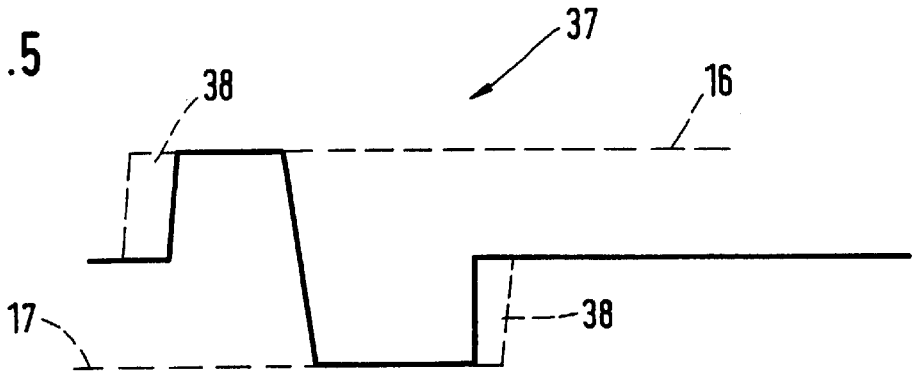
FIG. 5 shows the course of the control piston stroke travel between the control edges on the low-pressure side and on the high-pressure side.

During the upward-oriented stroke motion of the pump piston 4 from bottom dead center 35 to top dead center 36, a lower-level holding current 43 is initially established at the control unit 15; the holding current value 43 remains set until the desired pressure buildup is desired. Depending on the required pressure buildup, the control edge 16 is closed during the pressure buildup phase, so that the triggering pulse can be effected depending on the desired pressure level within the pressure control range 33—indicated by the dashed line. The holding current spike and the holding current 42 leveling out at a holding current level 42 cause the control element 8 to move as shown in FIG. 5 from control edge 16 to control edge 17. The regions 38 along the stroke course 37 of the control element define transitional regions within which the times of control element motion and thus the quantity of fuel to be injected can be varied. While the holding current 42 is maintained, the control edge 17 is closed toward the low-pressure chamber 18, and the injection can take place through the opened control edge 16 into the bore 19 that acts on the injection nozzle 14. Depending on the duration of the holding current 42 during the injection quantity control region 34, or in other words depending on the time when the holding current level 42 drops to the level 43, a compensatory motion of the control element 8 takes place in such a way that as shown in FIG. 5, the control element assumes a middle position between the control edges 16 and 17 and short-circuits the pressure chamber 5 to the low-pressure chamber 18, causing a rapid drop in the built-up pressure.

A comparison of the course over time of the current changes and positional changes of the control element 8 within the sleeve 12 shows that the suitably metered injection quantity is attained before the pump piston 4 reaches top dead center 36.

Figure 6:
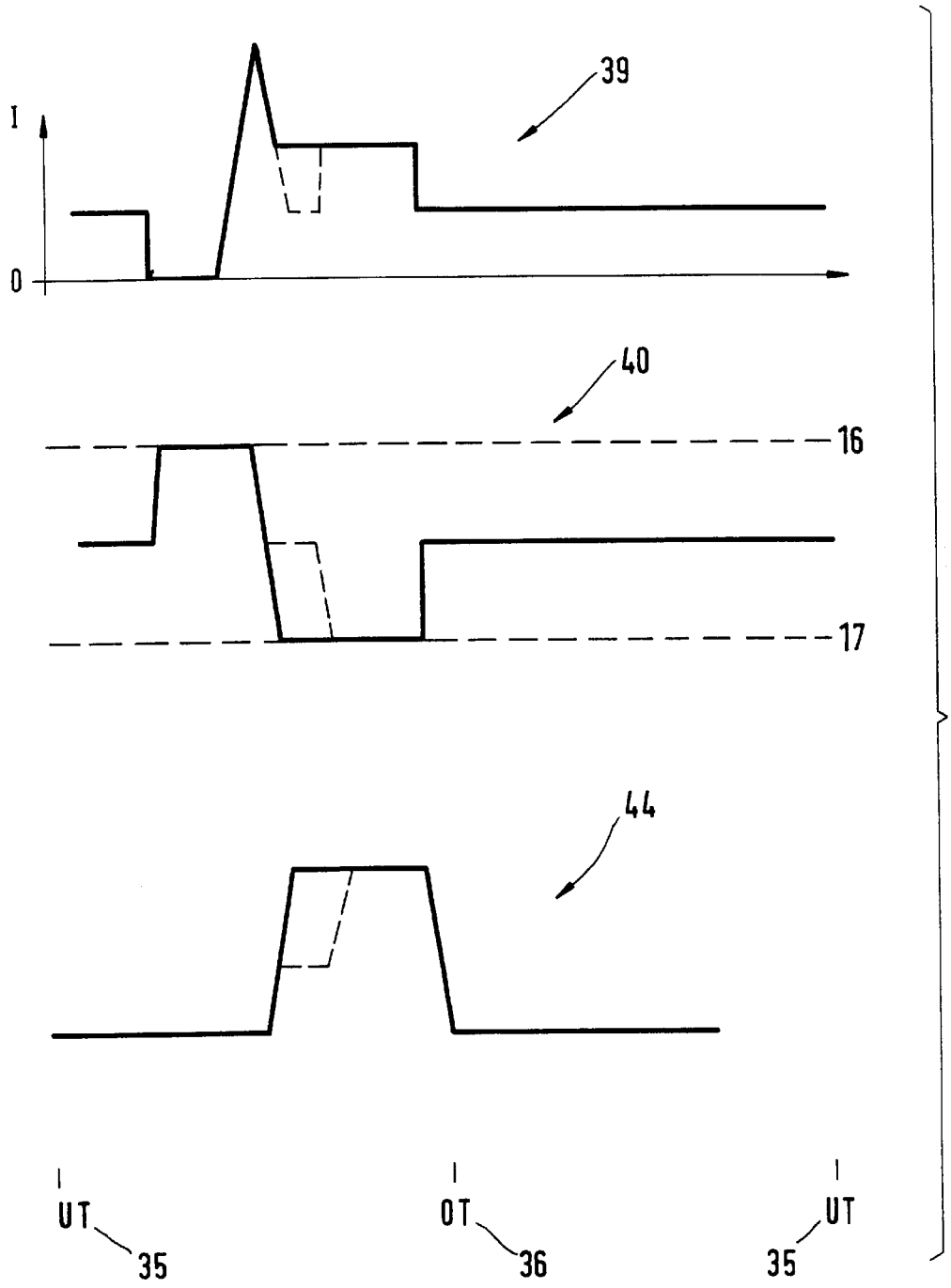
FIG. 6 shows the course of the parameters comprising current, control piston travel and injection course, plotted from bottom dead center to top dead center and back to bottom dead center.

FIG. 6 shows the course of the parameters comprising the holding current, control element stroke travel and injection course, plotted over the pump piston travel from bottom dead center to top dead center and vice versa.

The top two graphs substantially correspond to what is shown for FIGS. 4 and 5, already described, while the lowermost graph shows the injection course of the fuel quantity, plotted over the stroke travel of the pump piston from bottom dead center 35 to top dead center 36 and vice versa. The various regions shown in dashed lines mark the regions where a chronological variability in the injection event is possible by changing the holding currents at the magnetic actuator 6 via the control unit 15.

By means of the proposed triggering, all the injection parameters for optimizing combustion, whether they are the injection quantity, injection onset, injection pressure, or course of injection pressure, can be controlled electronically during the injection phase, and the embodiment selected definitively enhances system safety.

For instance, if the magnetic actuator 6 remains without current, then because the spring means is more strongly dimensioned, the control edge 16 of the control element 8 is always located on its seat face and closes the inlet to the high-pressure-side bore 19 to the injection nozzle 14, and as a result, filling of the pump is not made possible, and the system cannot execute any injection event. If the control element 8 becomes mechanically wedged in its open position inside the sleeve 12 of the pump element 3, only a delayed filling of the pressure chamber 5 occurs, and the low-pressure chamber 18 communicates constantly with the pressure chamber 5, and inflowing high-pressure fuel flows out to the low-pressure region 18 via the short circuit, so that an excess quantity of fuel does not attain injection. A power failure at the magnetic actuator 6 during pumping is provided for by embodying a pressure stage **8*a* on the circumference of the control element; this pressure stage has a diameter reduction of 0.05 mm to 0.2 mm, compared with the control element diameter. The pressure stage 8*a* and the spring means 10 on the magnet valve side both function as a safety valve for the pressure chamber 5, in such a way that at this valve, the maximum system pressure the maximum allowable load of the roller tappet 1 can be set, so that if this critical pressure is exceeded, the control chamber 18** on the low-pressure side is automatically opened, so that the fuel can flow into the low-pressure region without causing any damage.

The foregoing relates to preferred exemplary embodiments of the invention, it being understood that other variants and embodiments thereof are possible within the spirit and scope of the invention, the latter being defined by the appended claims.

| List of Reference Numerals: | |
|---|---|
| 1 | Roller tappet |
| 2 | Spring |
| 3 | Pump element |
| 4 | Pump piston |
| 5 | Pressure chamber |
| 6 | Magnetic actuator |
| 7 | Magnet |
| 8 | Control element |
| 8a | Pressure stage |
| 8.1 | Outer part |
| 8.2 | Inner part |
| 9 | Stroke stop |
| 10 | Spring means on the magnet valve side |
| 11 | Spring means on the low-pressure side |
| 12 | Sleeve |
| 13 | High-pressure line |
| 14 | Injection nozzle |
| 15 | Control unit |
| 16 | Control edge |
| 17 | Control edge |
| 18 | Low-pressure chamber |
| 19 | Inlet bore |

-continued

| List of Reference Numerals: | |
|---|---|
| 21 | Connecting bore |
| 22 | Outlet bore |
| 23 | Pressure chamber bore |
| 24 | Tang |
| 25 | Roller |
| 26 | Lubrication bore |
| 27 | Pin |
| 28 | Sealing element |
| 29 | Spring stop |
| 30 | Thread |
| 31 | Annular chamber |
| 32 | control edge |
| 33 | Pressure control range |
| 34 | Quantity control range |
| 35 | Bottom dead center |
| 36 | Top dead center |
| 37 | Control element stroke |
| 38 | Control range |
| 39 | Current course |
| 40 | Control element travel |
| 41 | Course of piston stroke |
| 42 | First holding current level |
| 43 | Second holding current level |

I claim:

1. A device for injecting fluid, which is at high pressure, through high-pressure lines to an injection nozzle (14), comprising: a pump element (3) having a control element (8) controlled by a magnetic actuator (6), which pump element, by means of the control element, can be made to communicate with the high-pressure lines; said control element (8) having at least two control edges (16 and 17); and first (10) and second (11) means for biasing the control element to a position in which one of the two control edges, (16), blocks communication between the pump element (3) and the high-pressure lines, and, upon actuation of said magnetic actuator (6), applies a balancing force to said control element to move said control element to a position in which both the control edges (16, 17) are open to permit communication between said pump element (3) and a low-pressure chamber (18).

2. The device of claim 1, wherein the control element (8) is guided in a sleeve (12) of the pump element (3).

3. The device of claim 1, wherein the first biasing means (10) is located at an end of the control element (8) adjacent the magnetic actuator and generates a greater biasing force on the control element (8) than the second biasing means (11) which is located at the opposite end of the control element adjacent the low-pressure chamber (18).

4. The device of claim 1, wherein the control element (8) is provided with a pressure stage **(8*a*) near the at least one control edge (16) in an annular chamber (31) surrounding the control element (8)**.

5. The device of claim 4, wherein the pressure stage **(8*a*) has a reduced-diameter region which is between 0.05 mm and 0.2 mm less than the diameter of an adjoining region of the control element (8)**.

6. The device of claim 1, characterized in that the control element (8) comprises two joined-together components (8.1, 8.2).

7. The device of claim 1, wherein the control element (8) is movable into an intermediate position with a half-length stroke by the magnetic actuator (6), in cooperation with the action of the first and second biasing means (10, 11).

8. The device of claim 7, wherein the pump element (3) has a pressure chamber (5), and, in the intermediate position of the control element (8), the communications between the low-pressure chamber (18), nozzle (14) and pressure chamber (5) are opened.

9. The device of claim 7, wherein in the intermediate position of the control element, the force of the magnetic actuator (6) and the force of the first biasing means (11) and that of the second biasing means (10) are in equilibrium.

* * * * *